US006515667B1

(12) United States Patent
Haneda et al.

(10) Patent No.: US 6,515,667 B1
(45) Date of Patent: Feb. 4, 2003

(54) DISPLAY DEVICE, DISPLAY METHOD, AND STORAGE MEDIUM CONTAINING DISPLAY CONTROL PROGRAM

(75) Inventors: Isamu Haneda, Kyoto (JP); Toshitaka Kaneda, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/455,324

(22) Filed: Dec. 6, 1999

(30) Foreign Application Priority Data

Dec. 9, 1998 (JP) ..... 10-350057

(51) Int. Cl.[7] ..... G09G 5/373
(52) U.S. Cl. ..... 345/472; 345/698
(58) Field of Search ..... 345/472, 472.2, 345/698, 699

(56) References Cited

U.S. PATENT DOCUMENTS 5,001,697 A * 3/1991 Torres
5,517,209 A * 5/1996 Holland et al.
5,909,205 A * 6/1999 Furuhashi et al.

FOREIGN PATENT DOCUMENTS

JP A-10 83168 3/1998

* cited by examiner

*Primary Examiner*—Jeffery Brier
(74) *Attorney, Agent, or Firm*—Birch, Stewart, Kolasch, & Birch, LLP

(57) ABSTRACT

A display device is provided having a display section for displaying a window frame of a standard pixel number. A data acquiring section is provided for acquiring image data of a given pixel number from any of various applications. An image data storing section is provided for storing therein the image data. A pixel number determining section is also provided for determining the pixel number based on attribution data that is attached to the image data. A pixel number judgment section is provided for judging whether or not the pixel number is smaller than the standard pixel number preliminarily stored in a standard pixel number storing section. A data expanding section is provided for expanding the image data to increase the pixel number of the image data to the standard pixel number, if the pixel number is smaller than the standard pixel number. A display control section is provided for controlling the display section to display the expanded image data in the window frame of the standard pixel number so that the window frame which contains the expanded image data can coexist with a window frame which contains image data of the standard pixel number on the display section. In addition, a character detecting section is provided for detecting font data and a character code in the image data. A font replacing section retrieves from a font data storing section a font data of a font size that corresponds to a scaling factor and replaces the font data of the image data with the retrieved font data.

1 Claim, 7 Drawing Sheets

DISPLAY DEVICE, DISPLAY METHOD, AND STORAGE MEDIUM CONTAINING DISPLAY CONTROL PROGRAM

CROSS-REFERENCE TO RELATED APPLICATIONS

This application is related to Japanese Patent Application No. HEI 10(1998)-350057 filed on Dec. 9, 1998 whose priority is claimed under 35 USC §119, the disclosure of which is incorporated herein by reference in its entirety.

BACKGROUND OF THE INVENTION

1. Field of the Invention

The present invention relates to a display device, a display method and a storage medium containing therein a display control program for displaying image data of a standard pixel number converted from image data of a pixel number different from the standard pixel number.

2. Description of the Related Arts

Conventional liquid crystal display devices often suffer from such a problem that an unsightly image is displayed on a liquid crystal panel thereof when display data of a lower resolution than the resolution of the liquid crystal panel is inputted thereto.

A first approach to this problem is disclosed in Japanese Unexamined Patent Publication No. HEI 10(1998)-83168, which proposes a liquid crystal display device which is capable of expanding image signals (image data) of a lower resolution than the resolution of a liquid crystal display panel thereof to display the image data on a greater scale.

The liquid crystal display device is arranged in the following manner.

Each pixel in display data is simply doubled for the data expansion.

A pixel to be interpolated between adjacent pixels is produced by processing display data of the adjacent pixels by means of a horizontal computation circuit and a vertical computation circuit for weighing display data.

When display data of a lower resolution than the resolution of the liquid crystal display panel is inputted to the display device, a scanning drive circuit for scanning the liquid crystal display panel horizontally and vertically expands the display data by increasing the number of horizontally arranged dots and the number of lines to display the display data on a greater scale on the liquid crystal display panel.

FIG. 8 is a diagram illustrating an image data expanding process according to a second approach to the aforesaid problem. In accordance with the second approach, where a code of a character is included in image data of a lower resolution, for example, the character is processed as dot data and enlarged on a dot basis. Therefore, when original characters represented by image data 30 are enlarged, jaggy characters represented by image data 31 are displayed as shown in FIG. 8.

In the first approach, however, where predetermined image data is scaled up or down, the scaling factor is controlled by variably setting the number of lines to which a voltage is to be selectively applied by the scanning drive circuit. Therefore, it is necessary to preliminarily set the number of lines for the voltage application in accordance with the scaling factor. This makes it impossible to concurrently display image data of different resolutions.

In the second approach, the characters are processed as dot data and enlarged on a dot basis, so that the enlarged characters are unsightly with jaggy profiles.

SUMMARY OF THE INVENTION

In accordance with the present invention, there is provided a display device which comprises: a display section for displaying a window frame of a standard pixel number; a data acquiring section for acquiring image data of a given pixel number from any of various applications; an image data storing section for storing therein the image data; a pixel number determining section for determining the pixel number on the basis of attribution data attached to the image data; a pixel number judgment section for judging whether or not the pixel number is smaller than the standard pixel number preliminarily stored in a standard pixel number storing section; a data expanding section for expanding the image data to increase the pixel number of the image data to the standard pixel number, if the pixel number is smaller than the standard pixel number; and a display control section for controlling the display section to display the expanded image data in the window frame of the standard pixel number so that the window frame which contains the expanded image data can coexist with a window frame which contains image data of the standard pixel number on the display section.

With this arrangement, the image data of the standard pixel number and the image data whose pixel number has been increased to the standard pixel number from the pixel number smaller than the standard pixel number can concurrently be displayed in different window frames on the display section.

DETAILED DESCRIPTION OF PREFERRED EMBODIMENTS

Figure 1:
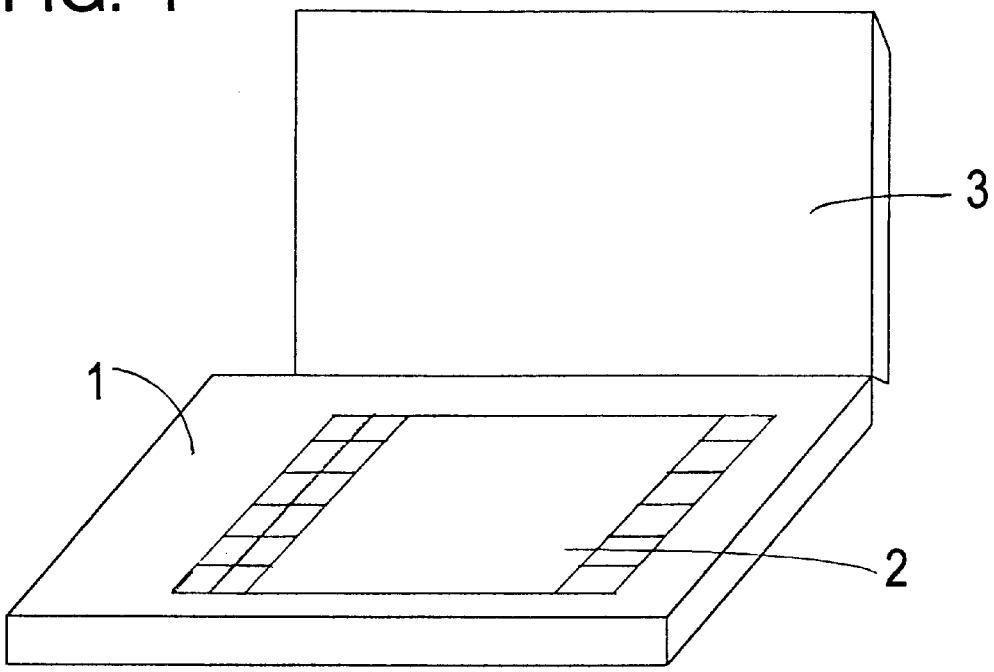
FIG. 1 is a perspective view illustrating the appearance of an information processing apparatus to which the present invention is applied.

A general explanation will first be given to the present invention.

A display device according to the present invention comprises: a display section for displaying a window frame of a standard pixel number; a data acquiring section for acquiring image data of a given pixel number from any of various applications; an image data storing section for storing therein the image data; a pixel number determining section for determining the pixel number on the basis of attribution data attached to the image data; a pixel number judgment section for judging whether or not the pixel number is smaller than the standard pixel number preliminarily stored in a standard pixel number storing section; a data expanding section for expanding the image data to increase the pixel number of the image data to the standard pixel number, if the pixel number is smaller than the standard pixel number; and a display control section for controlling the display section to display the expanded image data in the window frame of the standard pixel number so that the window frame which contains the expanded image data can coexist with a window frame which contains image data of the standard pixel number on the display section.

In the present invention, the display section may be comprised, for example, of a liquid crystal display panel (LCDP), a plasma display panel (PDP) or the like.

The data acquiring section may be comprised, for example, of a communications apparatus, a digital camera or the like.

The image data storing section and the standard pixel number storing section may be comprised, for example, of a RAM, a ROM, an EEPROM, a floppy disk, an MD, a hard disk or the like.

The pixel number determining section, the pixel number judgment section, the data expanding section and the display control section may be comprised, for example, of a CPU of a computer and a control program.

In accordance with the present invention, the image data of the standard pixel number and the expanded image data whose pixel number has been increased to the standard pixel number from the pixel number smaller than the standard pixel number can concurrently be displayed in different window frames on the display section.

Even if a plurality of image data having different pixel numbers (resolutions) are acquired from various applications, a user can concurrently display the plurality of image data in different window frames without any special consideration.

The display device may further comprise: a character detecting section for detecting font data and a character code in the image data in response to a judgment made by the pixel number judgment section that the pixel number of the image data stored in the image data storing section is smaller than the standard pixel number; a font size determining section for determining a font size for the character code on the basis of the attribution data attached to the image data; a font data storing section which stores therein font data of various font sizes for character codes; and a font replacing section for retrieving, from the font data storing section, font data of a font size which corresponds to a scaling factor employed for the image data expansion by the data expanding section, and replacing the font data of the image data with the retrieved font data.

The character detecting section, the font size determining section, and the font replacing section may be comprised, for example, of a CPU of a computer and a control program.

The font data storing section may be comprised, for example, of a ROM, an EEPROM, a floppy disk, an MD, a hard disk or the like.

With this arrangement, where font data (character) is included in the image data of the pixel number smaller than the standard pixel number, the font data is replaced with font data of a font size (character size) which corresponds to the scaling factor employed for the image data expansion, so that the character is displayed on the basis of the latter font data. Therefore, a more legible character can be displayed on the display section than a character enlarged on a dot basis.

The standard pixel number may be a pixel number for a VGA (video graphics array) frame, and the pixel number smaller than the standard pixel number may be a pixel number for a QVGA (quarter video graphics array) frame.

In this case, the pixel number (640×480 dots) for the VGA frame and the pixel number (320×240 dots) for the QVGA frame are stored in the standard pixel number storing section.

With this arrangement, when image data of the pixel number for the QVGA frame is to be displayed on the display section, the image data is automatically expanded to image data of the pixel number for the VGA frame.

A display method according to the present invention comprises the steps of: acquiring image data of a given pixel number from any of various applications by means of a data acquiring section; storing the image data in an image data storing section; determining the pixel number on the basis of attribution data attached to the image data by means of a pixel number determining section; judging by means of a pixel number judgment section whether or not the pixel number is smaller than a standard pixel number preliminarily stored in a standard pixel number storing section; expanding the image data by means of a data expanding section to increase the pixel number of the image data to the standard pixel number, if the pixel number is smaller than the standard pixel number; and controlling a display section by means of a display control section to display the expanded image data in a window frame of the standard pixel number so that the window frame which contains the expanded image data can coexist with a window frame which contains image data of the standard pixel number on the display section.

The present invention will hereinafter be described in detail by way of an embodiment thereof. However, it should be understood that the invention be not limited to the embodiment.

FIG. 1 is a perspective view illustrating the appearance of an information processing apparatus to which the present invention is applied. In FIG. 1, there are shown a main cabinet 1, an input/output section 2 and a cover 3.

The main cabinet 1 has the input/output section 2, which includes a display section such as comprised of an LCD (liquid crystal display) or a PD (plasma display) and a transparent tablet integrally provided on the top of the main cabinet 1. The main cabinet 1 further has an infrared communications section, a pen, a main power switch and the like which are provided on the exterior thereof, and incorporates therein a control circuit for controlling the input/output section 2, the infrared communications section, the pen and the like, an interface, and a power section for supplying driving voltages to the respective components.

The cover 3 is hinged to the rear side of the main cabinet 1 so as to be pivoted to cover the input/output section 2 for protection of the input/output section 2 during transportation of the apparatus.

Figure 2:
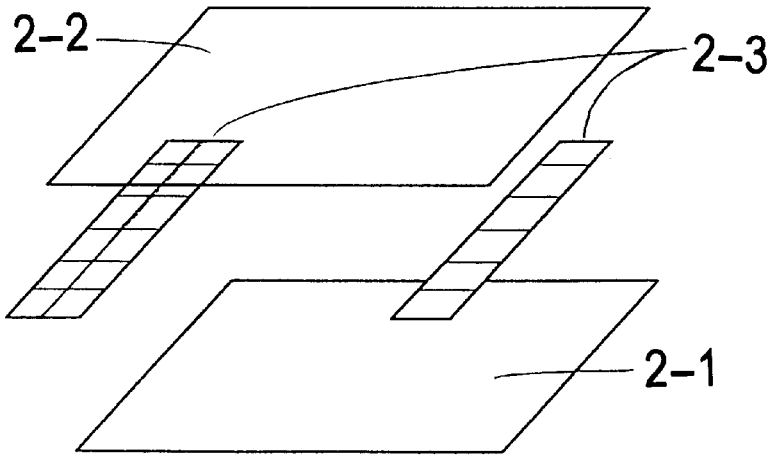
FIG. 2 is an exploded view illustrating the construction of an input/output section of the information processing apparatus.

FIG. 2 is an exploded view illustrating the construction of the input/output section of the information processing apparatus. As shown in FIG. 2, the input/output section 2 includes a thin liquid crystal display section 2-1 of a matrix type capable of displaying characters, and a transparent tablet 2-2 having a size sufficient to cover the liquid crystal display section 2-1 and provided integrally with the liquid crystal display section 2-1.

The liquid crystal display section 2-1 may, as required, include a backlight such as of an EL panel provided on the back side thereof.

The transparent tablet 2-2 includes, for example, a pair of transparent sheets, a pair of transparent electrodes respectively provided on inner surfaces of the transparent sheets, and minute spacer projections regularly printed on the sheets for preventing the pair of transparent electrodes from being brought into contact with each other in a normal state. When the transparent tablet 2-2 is operated with a finger or a pen for input of an instruction, the electrodes are brought into contact with each other so that an operated position on the transparent tablet 2-2 can be detected.

A film 2-3 on which icons indicative of functions of fixed keys in frequent use are printed is provided between the liquid crystal display section 2-1 and the transparent tablet 2-2. Areas of the transparent tablet 2-2 corresponding to the respective icons serve as the fixed keys.

An area of the liquid crystal display section 2-1 which is selected by a user can be detected by synchronizing display information displayed on the liquid crystal display section 2-1 with positional information on the transparent tablet 2-2.

Figure 3:
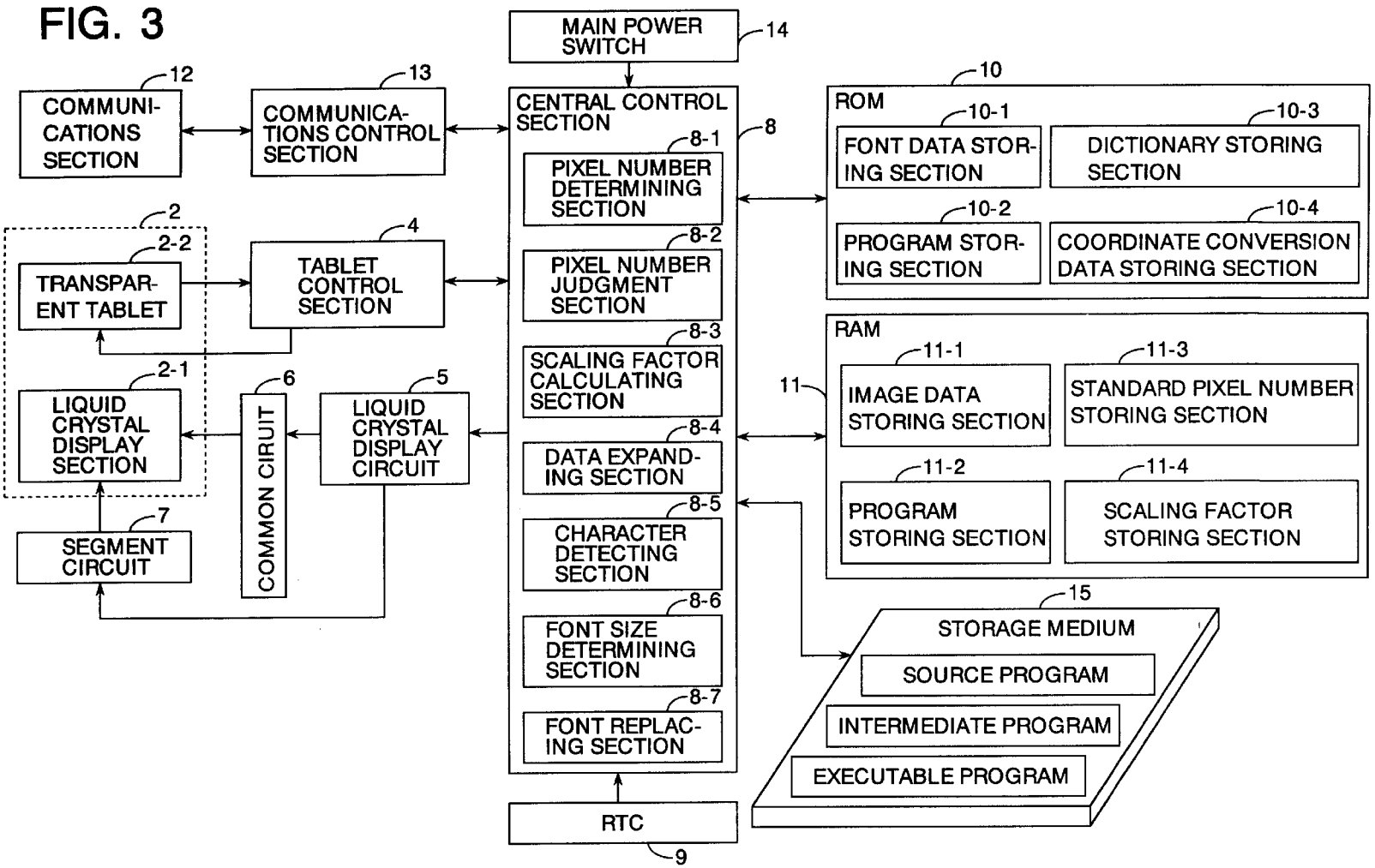
FIG. 3 is a block diagram illustrating the overall construction of the information processing apparatus.

FIG. 3 is a block diagram illustrating the overall construction of the information processing apparatus. In FIG. 3, the same components as shown in FIGS. 1 and 2 are denoted by the same reference characters.

Since the constructions and functions of the liquid crystal display section 2-1 and the transparent tablet 2-2 of the input/output section 2 have been described with reference to FIG. 2, no explanation will be given thereto.

A tablet control section 4 for acquiring coordinate information from the transparent tablet 2-2 determines coordinates of a position on the transparent tablet 2-2 which is operated by the user with his finger or the pen, on the basis of a contact between the transparent electrodes provided on the transparent sheets of the transparent tablet 2-2.

A liquid crystal display circuit 5 serves as a display control section for controlling the liquid crystal display section 2-1, and stores dot positions of liquid crystal cells to be lit as a bit map. As required,the liquid crystal display circuit 5 applies signals to a common circuit (X-coordinate electrode driving circuit) 6 and a segment circuit (Y-coordinate electrode driving circuit) 7.

A central control section 8 is comprised of a computer including a CPU, a ROM, a RAM and an I/O port, and is adapted to control the tablet control section 4, a ROM 10, a RAM 11, the liquid crystal display section 2-2 and a communications control section 13. The central control section 8 functions as a pixel number determining section 8-1, a pixel number judgment section 8-2, a scaling factor calculating section 8-3, a data expanding section 8-4, a character detecting section 8-5, a font size determining section 8-6 and a font replacing section 8-7, which will be described later with reference to FIG. 4.

An RTC (real time clock) 9 keeps time on the basis of clock signals applied thereto from an oscillator (not shown), and outputs a current time, date, month and year to the central control section 8.

The ROM 10 includes a font data storing section 10-1 which stores therein font data for character codes to be displayed on the liquid crystal display section 2-1, a program storing section 10-2 which stores therein programs on the basis of which the central control section 8 controls the apparatus, a dictionary storing section 10-3 which stores therein a dictionary for character conversion, and a coordinate conversion data storing section 10-4 which stores therein conversion data for converting coordinates detected by the tablet control section 4 into coordinates of a display position (an icon or a fixed key). The font data storing section 10-1 stores therein font data of various font sizes.

The RAM 11 includes an image data storing section 11-1 for storing therein text data and graphic data to be inputted from the input/output section by the user and various image data to be inputted from the communications section, a program storing section 11-2 for storing therein a control program to be installed from a storage medium 15 by program loading means not shown, a standard pixel number storing section 11-3 for storing therein a standard pixel number of image data to be displayed, and a scaling factor storing section 11-4 for storing therein a scaling factor which is obtained by comparing the standard pixel number with a pixel number of the acquired application image data.

For example, application image data for personal computers is used in a graphics system called VGA (video graphics array) and having a pixel number of 640×480 dots, and application image data for personal digital assistants is used in a graphics system called QVGA (quarter video graphics array) and having a pixel number of 320×240 dots.

Therefore, pixel numbers of application image data to be acquired through the communications section include the VGA pixel number and the QVGA pixel number.

In this embodiment, the standard pixel number storing section 11-3 stores therein a pixel number of 640×240 dots for the VGA frame and a pixel number of 320×240 dots for the QVGA frame as the standard pixel number.

A reference numeral 12 denotes the communications section, which is to be connected, for example, to a communications line/internet under the control of the communications control section 13 for reception and transmission of E-mails and application image data. The communications section 12 serves as a data acquiring section for acquiring various image data having different pixel numbers from any of various applications. A digital camera (CCD camera) may further be provided as the image data acquiring section.

A reference numeral 14 denotes the main power switch. By operating the main power switch 14, a built-in power source is turned on and off.

The storage medium 15 is separable from the main body of the apparatus, and is comprised of, for example, of a CD-ROM, a floppy disk, an IC card or the like. The storage medium 15 stores therein an executable program to be loaded into the program storing section 11-2 of a nonvolatile memory in the main cabinet 1 for execution thereof, a source program from which an executable program is derived, and/or an intermediate program.

Where a display control program according to the present invention has not been installed in the ROM 10 in the main cabinet 1, the display control program is loaded into the RAM 11 from the storage medium 15 by the program loading means not shown. Executable program codes are stored in the program storing section 11-2 of the RAM 11, while data is stored in the image data storing section 11-1 of the RAM 11.

The storage medium 15 contains therein a display control program for causing the computer of the central control section 8 to perform a display control process. More specifically, the storage medium 15 stores therein a display control program which performs the functions of: acquiring image data of a given pixel number from any of various applications; storing the image data in the image data storing section 11-1; determining the pixel number of the image data on the basis of attribution data attached to the image data; judging whether or not the pixel number is smaller than the standard pixel number preliminarily stored in the standard pixel number storing section 11-3; expanding the image data to increase the pixel number of the image data to the standard pixel number, if the pixel number is smaller than the standard pixel number; and controlling the display section 2-1 to display the expanded image data in a window frame of the standard pixel number so that the window frame which contains the expanded image data can coexist with a window frame which contains image data of the standard pixel number on the display section 2-1.

With the display control program loaded from the storage medium 15 into the program storing section 11-2 of the RAM 11 of the information processing apparatus having the display device including the liquid crystal display section 2-1 and the transparent tablet section 2-2, the information processing apparatus can concurrently display image data of the standard pixel number and the expanded image data whose pixel number has been increased to the standard pixel number from the pixel number smaller than the standard pixel number in different window frames on the display device.

Figure 4:
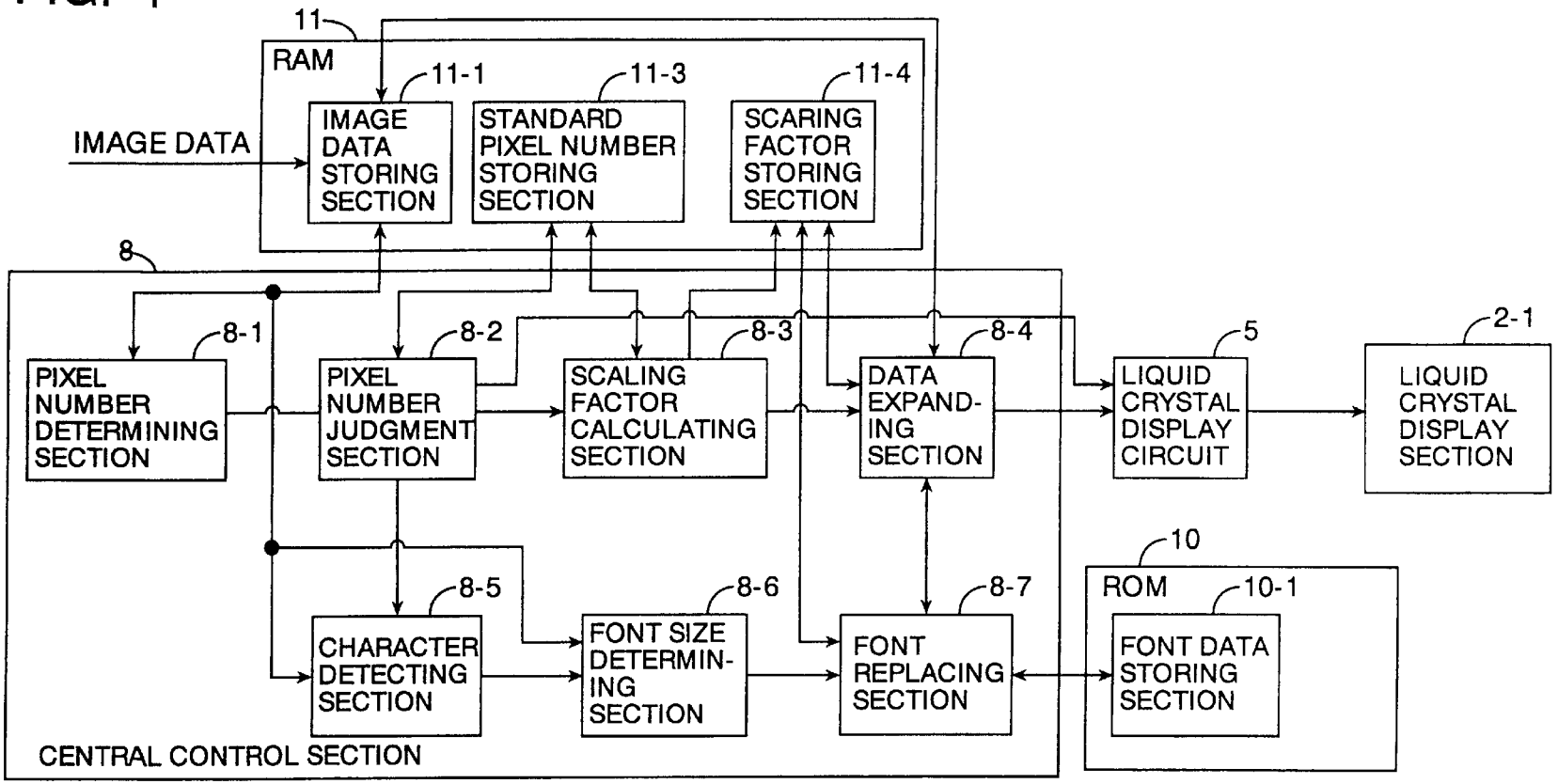
FIG. 4 is a block diagram illustrating a functional arrangement of the information processing apparatus according to an embodiment of the present invention.

FIG. 4 is a block diagram illustrating the functional arrangement of the information processing apparatus according to this embodiment. As shown in FIG. 4, the central control section 8 functions as the pixel number determining section 8-1, the pixel number judgment section 8-2, the scaling factor calculating section 8-3, the data expanding section 8-4, the character detecting section 8-5, the font size determining section 8-6, and the font replacing section 8-7.

The central control section 8 acquires application image data of a given pixel number through the communications section 12, and stores the image data in the image data storing section 11-1.

The pixel number determining section 8-1 reads the application image data out of the image data storing section 11-1, and determines the pixel number on the basis of attribution data attached to the image data.

With reference to the VGA and QVGA pixel numbers (image sizes) stored in the standard pixel number storing section 11-3, the pixel number judgment section 8-2 judges whether or not the pixel number of the image data to be displayed on the display section is smaller than the VGA standard pixel number, for example.

If the pixel number of the image data is equal to the VGA standard pixel number, the pixel number judgment section 8-2 outputs a signal indicative of the VGA standard pixel number to the liquid crystal display circuit 5, which in turn displays the image data of the standard pixel number as it is on the liquid crystal display section 2-1.

If the pixel number of the image data is equal to the QVGA pixel number which is smaller than the VGA pixel number, the pixel number judgment section 8-2 outputs to the scaling factor calculating section 8-3 and to the character detecting section 8-5 a signal which indicates that the pixel number of the image data is smaller than the VGA pixel number.

In the case where the pixel number of the image data is equal to the QVGA pixel number, the scaling factor calculating section 8-3 reads the VGA pixel number (640×480 dots) and the QVGA pixel number (320×240 dots) from the standard pixel number storing section 11-3, then calculates a scaling factor for the QVGA pixel number with respect to the VGA pixel number, and stores the calculated scaling factor in the scaling factor storing section 11-4.

In this case, the scaling factor for the QVGA pixel number with respect to the VGA pixel number is 2×2 (width×length).

The data expanding section 8-4 expands the application image data by the scaling factor read out of the scaling factor storing section 11-4, and outputs the expanded application image data to the liquid crystal display circuit 5.

The liquid crystal display circuit 5 controls the liquid crystal display section 2-1 to display the expanded image data as well as the image data of the standard pixel number in different window frames.

Figure 5:
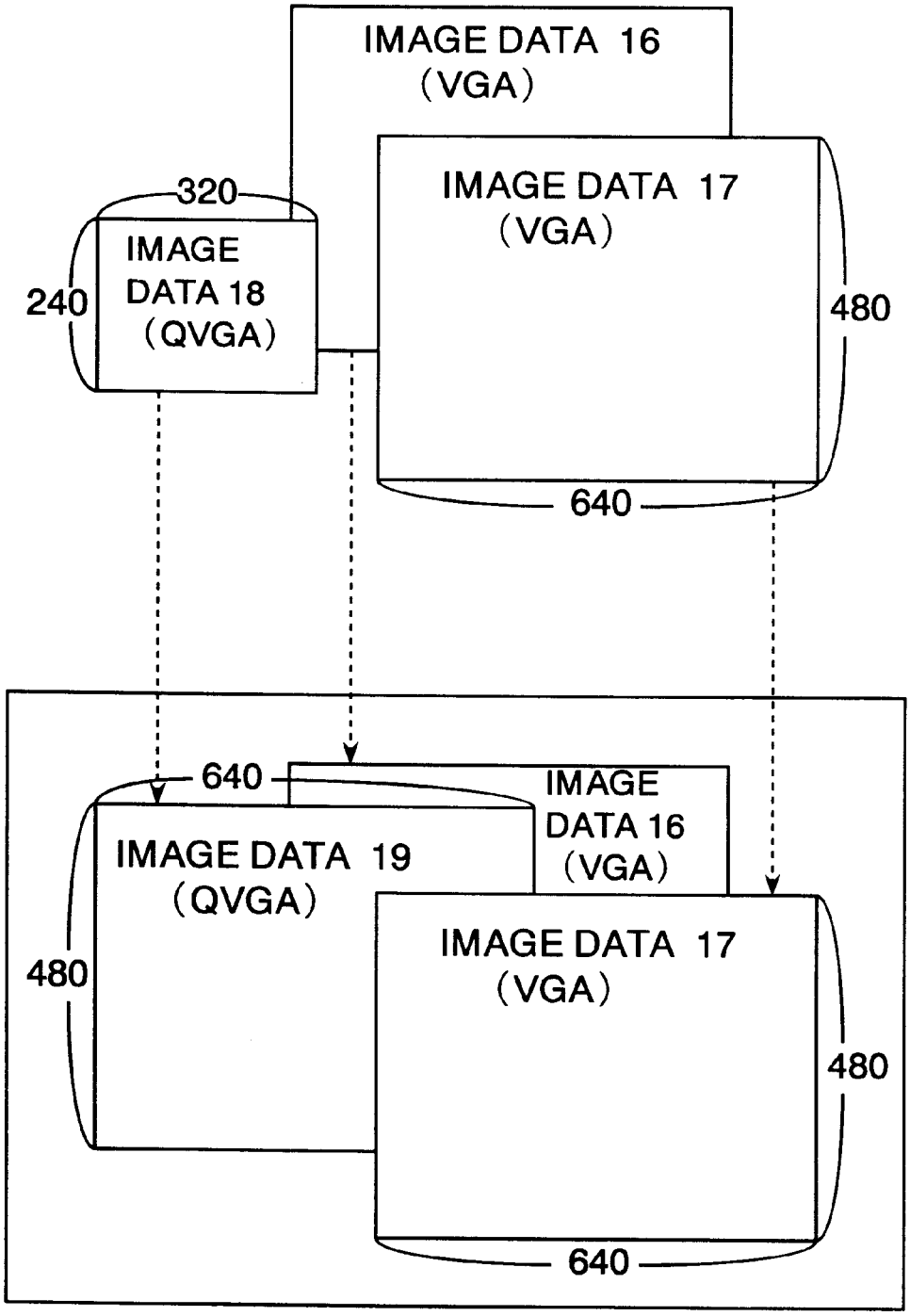
FIG. 5 is a diagram for explaining an exemplary image data display process according to the embodiment in which two types of image data having different pixel numbers are displayed on a display device.

FIG. 5 is a diagram for explaining an exemplary image data display process according to this embodiment in which two types of image data having different pixel numbers are displayed on the liquid crystal display section. As shown in FIG. 5, VGA application image data 16, 17 and QVGA application image data 18 are to be concurrently displayed in different window frames of the VGA standard pixel number (640×480 dots).

First, the pixel numbers (horizontally arranged dot number×vertically arranged dot number) of the application image data to be displayed are determined. The determined pixel numbers are compared with the VGA standard pixel number (640×480 dots) stored in the standard pixel number storing section 11-3.

As the result of the comparison of the pixel numbers with the standard pixel number, the pixel numbers of the image data 16, 17 are equal to the VGA pixel number, so that the image data 16, 17 are displayed as they are.

The image data 18, which is QVGA image data, has a smaller pixel number than the VGA standard pixel number.

Where the pixel number of the image data is smaller than the standard pixel number, the scaling factor calculating section 8-3 calculates the scaling factor (vertical scaling factor×horizontal scaling factor) which is to be employed for expansion of the image data by dividing the standard pixel number by the pixel number of the image data. In this case, the image data is QVGA image data and, therefore, a scaling factor of 2×2 is obtained by dividing 640×480 dots (standard pixel number) by 320×240 dots.

The data expanding section 8-4 expands the QVGA image data 18 by the scaling factor calculated by the scaling factor calculating section 8-3, and the expanded image data 19 is displayed.

The character detecting section 8-5 judges whether or not font data (text data) is present in the application image data stored in the image data storing section 11-1, by detecting a character code in the image data, upon reception of a judgment made by the pixel number judgment section 8-2 that the pixel number of the image data stored in the image data storing section 11-1 is smaller than the standard pixel number.

The font size determining section 8-6 determines a font size for the character code on the basis of attribution data included in the application image data.

The font data storing section 10-1 stores therein font data of various font sizes for various character codes.

The font replacing section 8-7 determines, on the basis of the scaling factor (2×2) stored in the scaling factor storing section 11-4, a font size which corresponds to the scaling factor employed for the data expansion by the data expanding section. The font data of the font size corresponding to the scaling factor is retrieved from the font data storing section 10-1, and the font data of the image data is replaced with the retrieved font data, which is outputted to the data expanding section 8-4.

The data expanding section 8-4 outputs the latter font data of the font size inputted from the font replacing section 8-7 to the liquid crystal display circuit 5. The liquid crystal display circuit 5 displays the character code on the liquid crystal display section 2-1 on the basis of the font data of the font size which corresponds to the scaling factor employed for the image data expansion.

Figure 6:
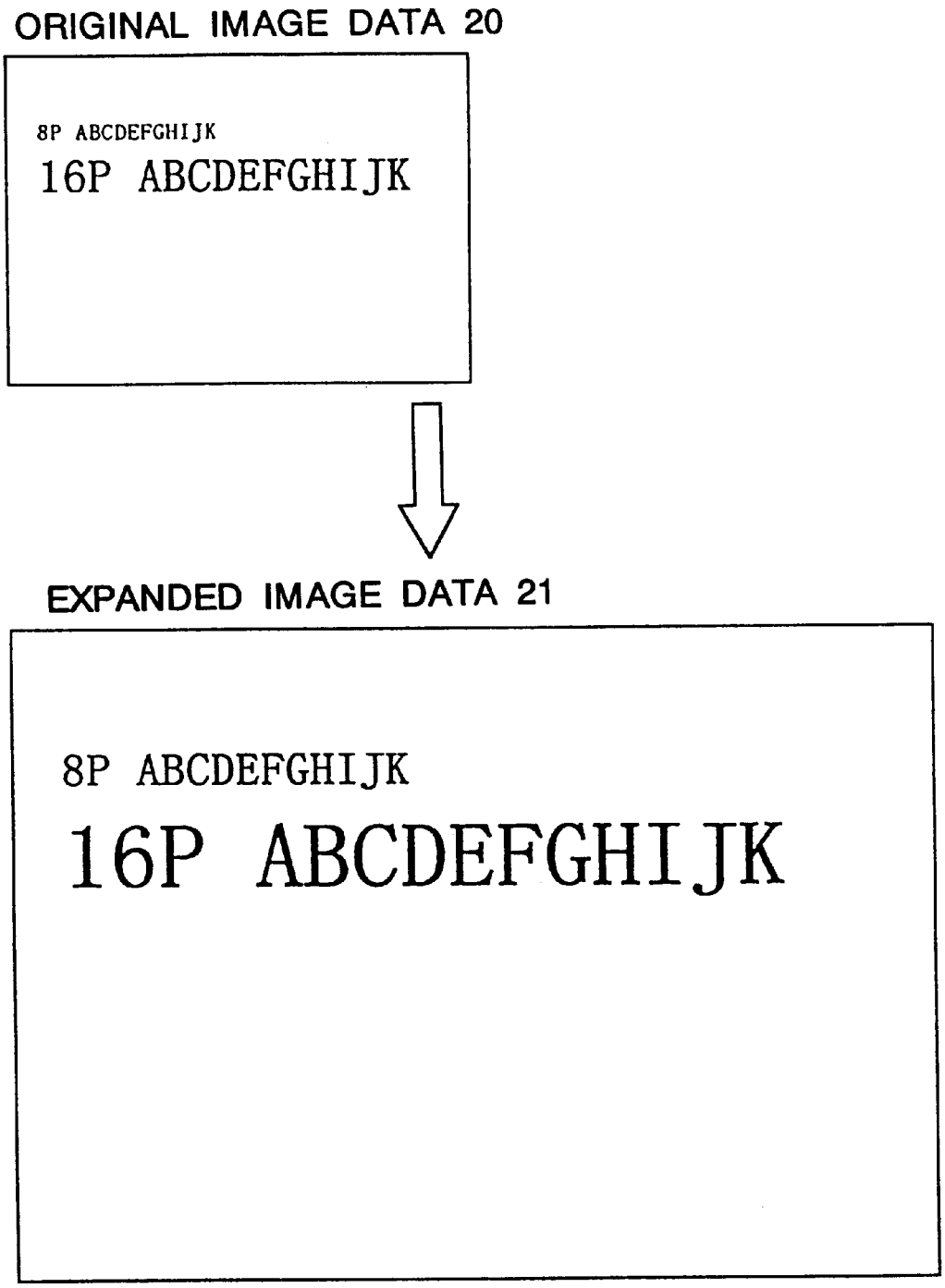
FIG. 6 is a diagram for explaining font data expansion in accordance with the embodiment.

FIG. 6 is a diagram for explaining the font data expansion according to this embodiment. As shown in FIG. 6, 8-point characters (font data) and 16-point characters (font data) of image data 20 are replaced with 16-point characters and 32-point characters, respectively, which are displayed as image data 21.

Thus, where a character (font data) is included in image data of a smaller pixel number than the standard pixel number, the font data is replaced with font data of a font size which corresponds to the scaling factor employed for the image data expansion, and a character is displayed on the basis of the latter font data. Therefore, the displayed character is more legible than a character enlarged on a dot basis.

Figure 7:
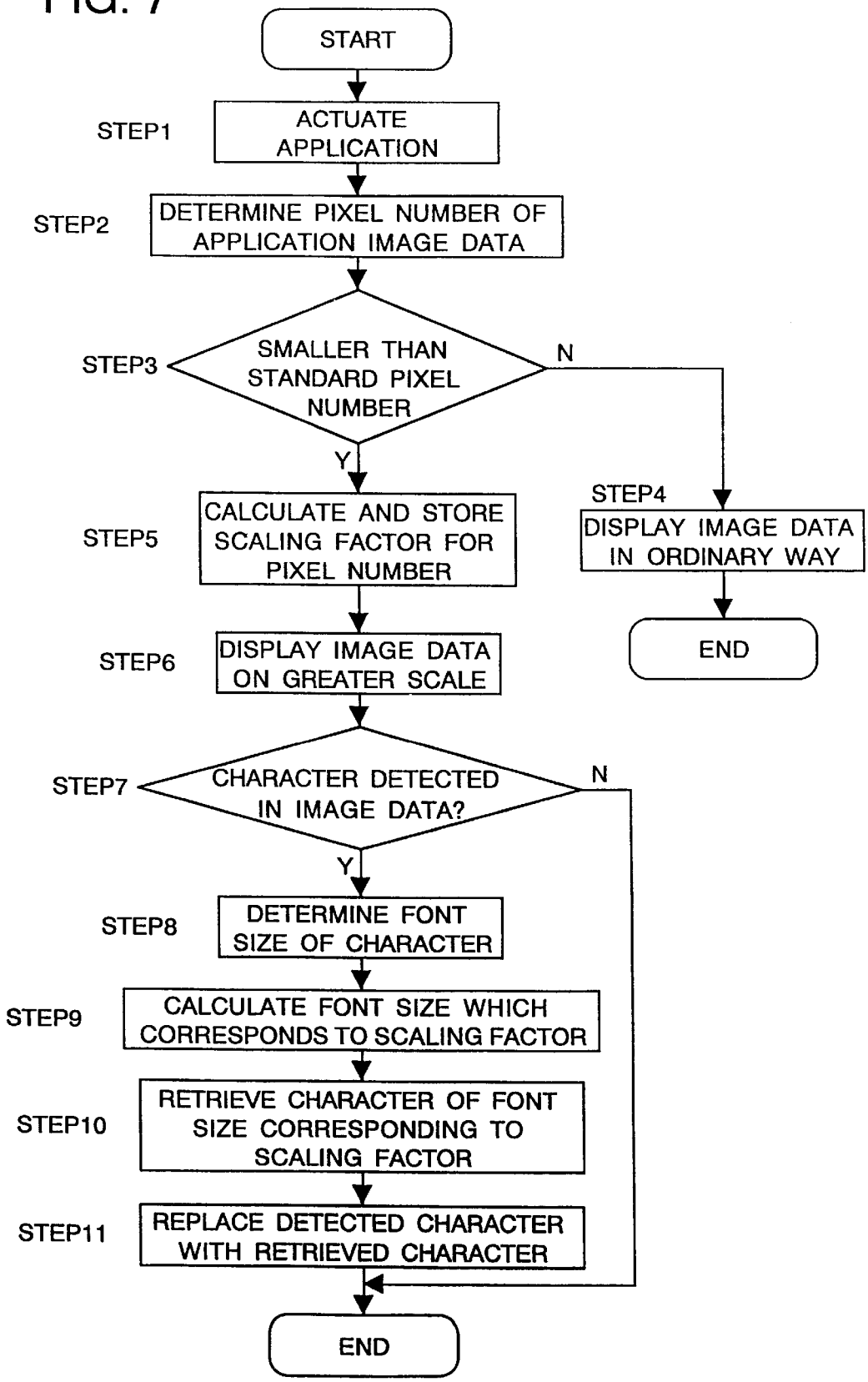
FIG. 7 is a flow chart for explaining a process according to the present invention.
Figure 8:
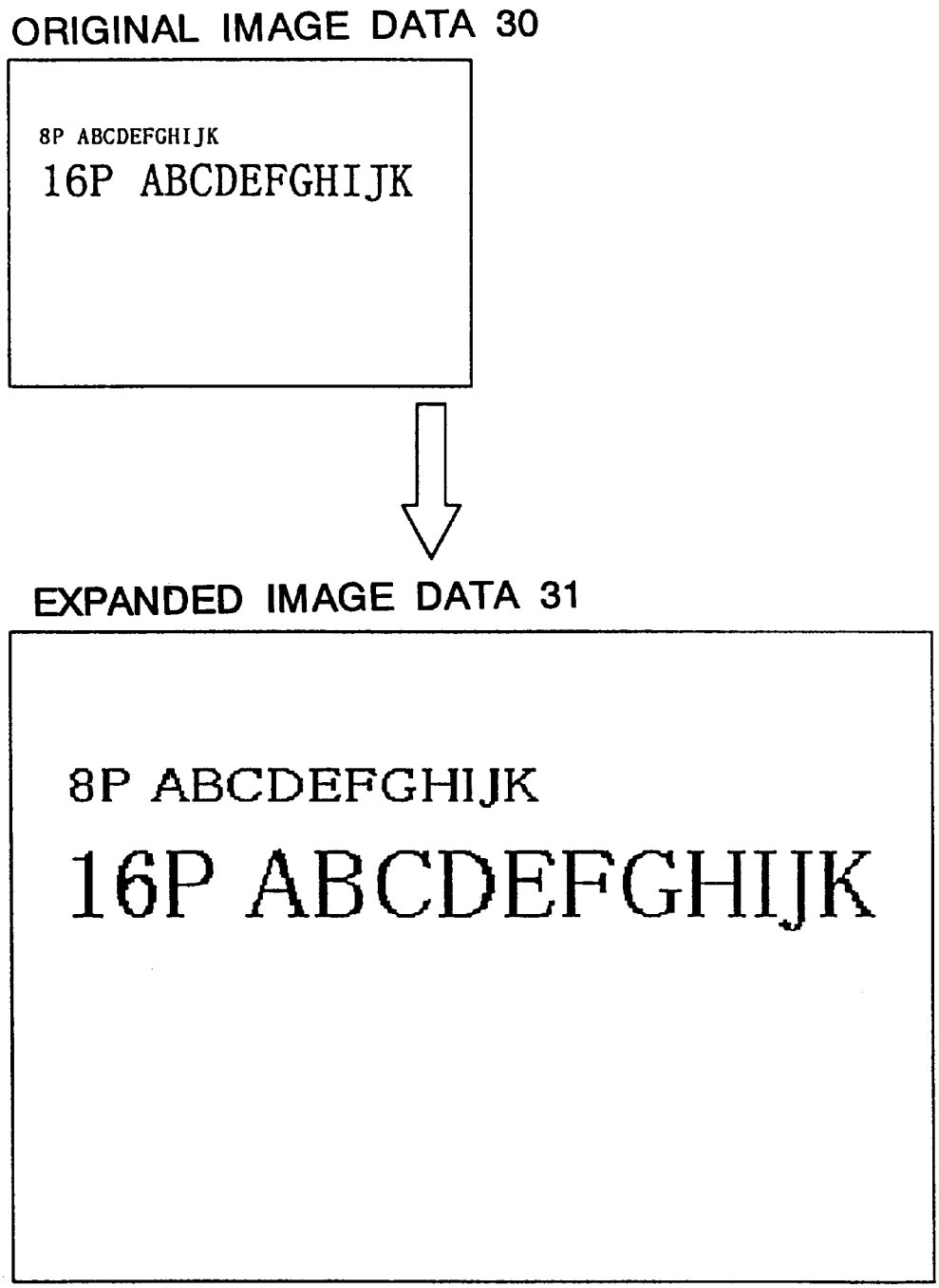
FIG. 8 PRIOR ART
FIG. 8 is a diagram for explaining image data expansion according to the prior art (second approach).

FIG. 7 is a flow chart for explaining the image data display process according to the present invention.

STEP 1: A desired application is actuated.

STEP 2: A pixel number of image data of the actuated application is determined on the basis of attribution data attached to the image data.

STEP 3: With reference to the VGA and QVGA pixel numbers stored in the standard pixel number storing section 11-3, it is judged whether or not the pixel number determined in STEP 2 is smaller than the VGA standard pixel number (640×480 dots). If the pixel number of the image data is smaller than the VGA standard pixel number, the program goes to STEP 5. If not, the program goes to STEP 4.

STEP 4: The image data is displayed in an ordinary manner, and the process ends.

STEP 5: A scaling factor (standard pixel number/determined pixel number) for the determined pixel number with respect to the standard pixel number is calculated, and stored in the scaling factor storing section 11-4.

STEP 6: The image data is expanded by the scaling factor stored in the scaling factor storing section 11-4 thereby to have the standard pixel number, and the expanded image data is displayed.

STEP 7: By detecting whether or not any character code is included in the application image data, it is judged whether or not font data for a character is included in the image data. If a character code is detected in the application image data, the program goes to STEP 8. If not, the program ends.

STEP 8: A font size of the character is determined on the basis of the font data for the detected character code.

STEP 9: The font size (point number) of the character to be employed for display of the character on a greater scale is calculated on the basis of the scaling factor (2×2) stored in the scaling factor storing section 11-4.

STEP 10: Font data (character) to be employed for the display on a greater scale is retrieved from the font data storing section 10-1 on the basis of the calculated font size and the detected character code.

STEP 11: If a character is detected in STEP 7, the character is replaced with the character retrieved in STEP 10, which is then displayed.

STEP 7 and STEP 11 are simultaneously performed.

Although the QVGA image data is expanded by a scaling factor of 2×2 and the expanded image data is displayed in the same manner as VGA image data in this embodiment, the image data to be processed is not limited to the VGA and QVGA image data, but application image data of any pixel number can be processed by calculating a scaling factor.

Therefore, application image data for a personal computer as well as application image data for a personal digital assistant, even though having different pixel numbers (resolutions), can concurrently be displayed in window frames of the same pixel number on a personal computer.

In accordance with the present invention, image data of a standard pixel number and expanded image data whose pixel number has been increased to the standard pixel number from a pixel number smaller than the standard pixel number can concurrently be displayed in window frames on the display section.

Therefore, even if plural types of application image data having different pixel numbers (resolutions) are acquired, a user can concurrently display the plural types of image data in different window frames of the standard pixel number without any special consideration.

What is claimed is:

1. A display device comprising:

a display section for displaying a window frame of a standard pixel number;

a data acquiring section for acquiring image data of a given pixel number from any of various applications;

an image data storing section for storing therein the image data;

a pixel number determining section for determining the pixel number on the basis of attribution data attached to the image data;

a pixel number judgment section for judging whether or not the pixel number is smaller than the standard pixel number preliminarily stored in a standard pixel number storing section;

a data expanding section for expanding the image data to increase the pixel number of the image data to the standard pixel number, if the pixel number is smaller than the standard pixel number;

a display control section for controlling the display section to display the expanded image data in the window frame of the standard pixel number so that the window frame which contains the expanded image data can coexist with a window frame which contains image data of the standard pixel number on the display section;

a character detecting section for detecting font data and a character code in the image data in response to a judgment made by the pixel number judgment section that the pixel number of the image data stored in the image data storing section is smaller than the standard pixel number;

a font size determining section for determining a font size for the character code on the basis of the attribution data attached to the image data;

a font data storing section which stores therein font data of various font sizes for character codes; and a font replacing section for retrieving, from the font data storing section, font data of a font size which corresponds to a scaling factor employed for the image data expansion by the data expanding section, and replacing the font data of the image data with the retrieved font data.

* * * * *